United States Patent [19]

Stollberg

[11] 4,163,494

[45] Aug. 7, 1979

[54] SHIPPING CONTAINER

[75] Inventor: Ray H. Stollberg, Gilroy, Calif.

[73] Assignee: Crown Zellerbach Corporation, San Francisco, Calif.

[21] Appl. No.: 906,190

[22] Filed: May 15, 1978

[51] Int. Cl.[2] ..... B65D 85/50

[52] U.S. Cl. ..... 206/423; 220/367; 229/6 A

[58] Field of Search ..... 206/423, 45.26; 229/6 A; 220/367; 217/42

[56] References Cited

U.S. PATENT DOCUMENTS

| | | | |
|---|---|---|---|
| 236,089 | 12/1880 | Roberts | 217/42 |
| 1,216,031 | 2/1917 | Wilcox | 220/367 |
| 1,993,383 | 3/1935 | Rossi | 206/45.26 |
| 2,345,000 | 3/1944 | Newsom | 229/6 A |

*Primary Examiner*—William T. Dixson, Jr.
*Attorney, Agent, or Firm*—Thomas R. Lampe

[57] ABSTRACT

A shipping container for cut flowers or the like comprising a tray and a cover for placement on the tray. Apertures are formed in the tray and cover which are in registry when the cover is placed on the tray to provide communication between the interior of the shipping container and ambient atmosphere. A closure flap is provided in the cover for selective placement over the apertures. The closure flap is hinged so that it may be quickly manually opened and locked in open position.

6 Claims, 7 Drawing Figures

SHIPPING CONTAINER

BACKGROUND OF THE INVENTION

It has been a long-standing practice in the floral industry to pre-cool cut flowers for shipment in order to prolong their freshness. Pre-cooling has customarily been done by packing the cut flowers into large corrugated trays and then storing them in refrigerated warehouses until the heat was dissipated out of the flowers. This retarded the natural deterioration that takes place after the flowers are cut. A recent development has been to force cool the cut flowers by utilizing a vacuum to suck out the warm moist air from the flowers and draw into the shipping container the low temperature ambient air in a refrigerated warehouse. It has been found that this process retards deterioration of the cut flowers for an even longer period than the aforedescribed conventional cooling process. The container of the present invention was developed for use in the vacuum cooling process. The present shipping container incorporates a closure means that may readily be opened on the ends of the container for vacuum cooling and then quickly manually closed to maintain the interior of the shipping container in a low temperature condition.

SUMMARY AND OBJECTS OF THE INVENTION

According to the present invention a shipping container for cut flowers and the like is provided which is of simple and economical construction but also incorporates a closure arrangement that readily adapts itself to the vacuum cooling process, and in particular, to being quickly manually opened so that a vacuum may be applied to the interior of the container to draw cooled air therein and just as quickly closed to retain the cooled air in the container after the forced cooling operation has been terminated.

This objective has been attained in accordance with the present invention by providing a shipping container for cut flowers and the like comprising a tray having a bottom wall and a plurality of tray side walls extending from the bottom wall, at least one of the tray side walls having an aperture formed therein. A cover is provided for placement on the tray, including a top wall and depending cover side walls, at least one of the cover side walls having an aperture formed therein, said apertures being in registry when the cover is placed on the tray. The cover additionally includes closure means manually movable between a first position whereat communication is established through the apertures in registry between the interior of the shipping container and the ambient atmosphere and a second position whereat said communication is interrupted. The closure means comprises a closure flap of generally rectangular configuration formed in the cover. The closure flap is comprised of first and second adjacent flap segments hingedly secured to one another with one of said segments being hingedly secured to the cover. The flap segments are foldable about their common hinge line and about a hinge line securing the one flap segment to the cover so that communication is established between the interior of the container and ambient atmosphere. The closure flap may be locked in this position by positioning one of the flap segments in a notch formed in the cover.

Other objects will be apparent from the following more detailed description and accompanying drawings in which:

DETAILED DESCRIPTION

Figure 1:
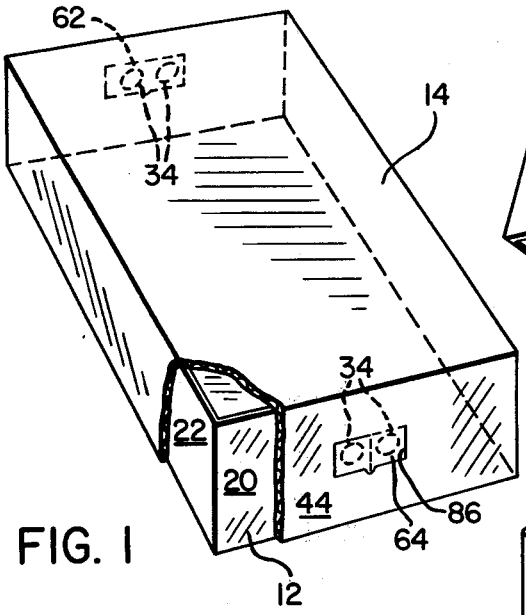
FIG. 1 is an isometric view of the shipping container hereof in fully assembled and set-up condition with a portion of the cover of the box partially broken away.
Figure 2:
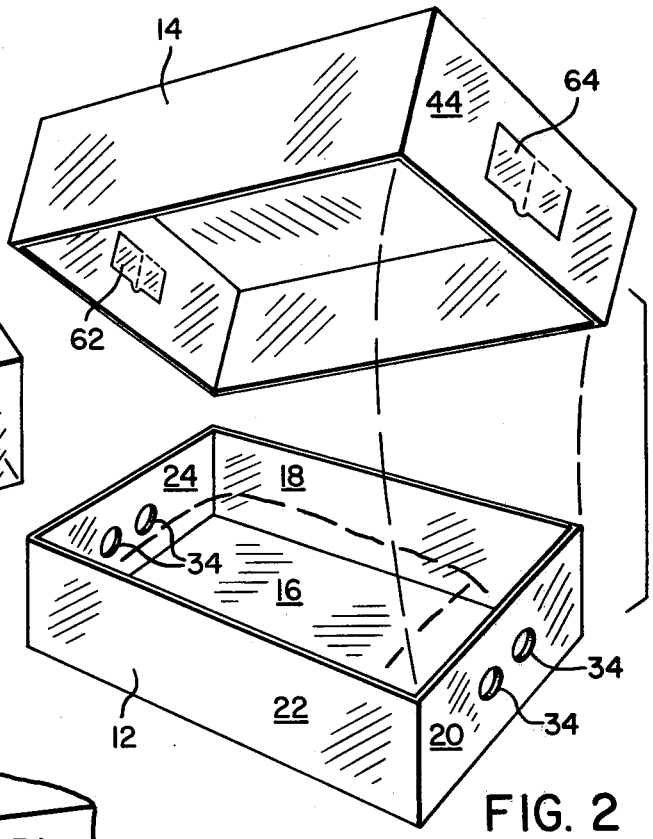
FIG. 2 is an exploded isometric view showing the cover portion of the shipping container just prior to its placement over the tray portion thereof.
Figure 6:
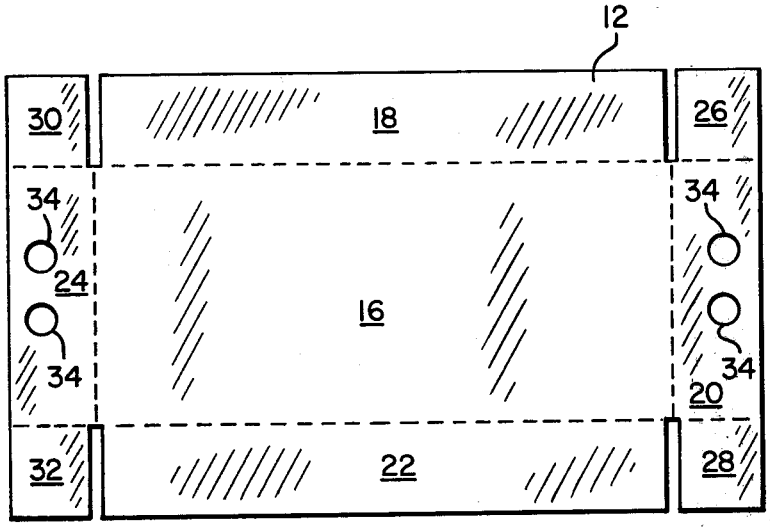
FIGS. 6 and 7 are plan views illustrating the tray and cover blanks, respectively, from which the shipping container is constructed.

Referring now to FIGS. 1 and 2 a shipping container constructed according to the teachings of the present invention is illustrated and comprises a tray component 12 and a cover component 14 adapted for placement over the tray, said components preferably being made of corrugated paperboard. Tray 12 is constructed from a one-piece blank illustrated in FIG. 6 and includes a bottom wall 16 and a plurality of tray side walls 18, 20, 22 and 24 connected to the bottom wall 16 along fold lines. When constructing the tray the side walls are formed at right angles to the bottom wall and flaps 26, 28, 30 and 32 which are connected to side walls 20 and 24 are brought into face to face relationship with side walls 18 and 22 and secured thereto in any desirable fashion such as gluing or stapling so that the blank assumes a permanent tray configuration. Side walls 20 and 24 are die cut to provide apertures 34 therein.

Figure 7:
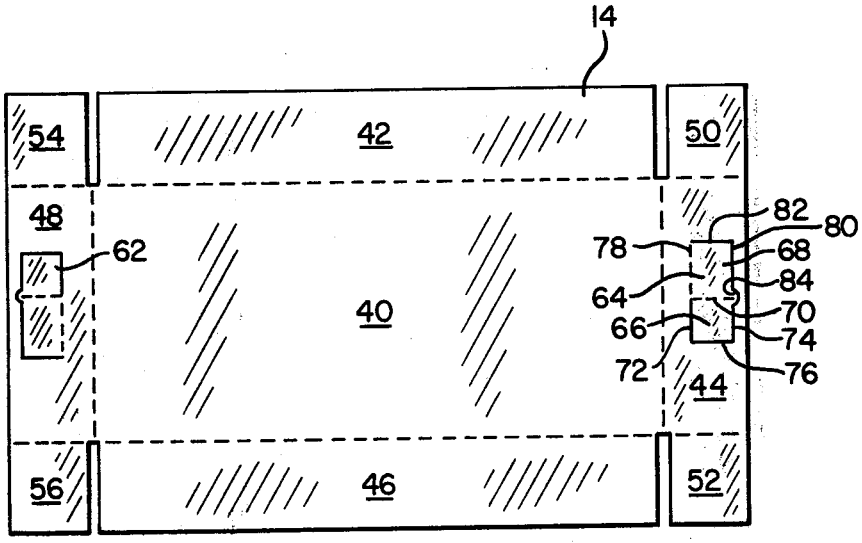

Referring now to FIG. 7, the blank used to construct the cover 14 is illustrated and includes a top wall 40 and cover side walls 42, 44, 46 and 48 connected thereto along fold lines. To assemble the cover, the cover side walls are positioned at right angles to the top wall and secured in such position by means of flaps 50, 52, 54 and 56 depending from cover side walls 44 and 48. Again, any suitable expedient such as glue, staples, etc. may be employed to secure the flaps to side walls 42 and 46. Closure means are provided in association with side walls 44 and 48, the closure means comprising closure flaps 62 and 64 integrally formed in their respective side walls. The closure flaps are of identical construction and details thereof will be described with particular reference to closure flap 64. In addition to FIG. 7, reference is also made to FIGS. 3 and 4 for details of the closure flap construction. Closure flap 64 is of generally rectangular configuration and is comprised of first and second adjacent flap segments 66 and 68 hingedly secured to one another along a first hinge line 70. First flap segment 66 is defined by the first hinge line, first and second lines of cut 72 and 74 formed in the cover extending from the opposed ends of the first hinge line and a third line of cut 76 formed in the cover interconnecting the first and second lines of cut and spaced from the first hinge line. The second flap segment is defined by the first hinge line 70, a second hinge line 78 between the closure flap and the remainder of the cover and extending substantially at right angles to the first hinge line from one end thereof, a fourth line of cut 80 formed in the cover and extending from the other end of the first hinge line and a fifthe line of cut 82 formed in the cover and extending between the fourth line of cut 80 and the second hinge line 78 and spaced from the first hinge line 70. The second and fourth lines of cut 74 and 80 are connected and form a notch 84 in the cover in communication with the aperture 86 that is formed in the cover when the closure flap 62 is opened.

The shipping container of the present invention functions as follows. First, the tray 12 is filled with the desired contents such as cut flowers and the cover is then placed over the tray and its contents so that the tray and cover assume the respective positions illustrated in FIG. 1. It will be noted that when the tray and cover are in such position the aperture 86 formed in cover side wall 44 is in registry with the aperture 34 formed in the tray side wall 20. In FIG. 1 the closure flap 64 is illustrated as being in a position, hereinafter referred to as the second position, wherein communication between the interior of the shipping container and ambient atmosphere is interrupted by the closure flap. When it is desired to vacuum-cool the contents of the shipping container, a step that normally occurs almost immediately after packing of the container with its contents, the closure flap 64 is manually manipulated so that it assumes the position illustrated in FIGS. 3 and 4 with communication being established between the interior of the shipping container and ambient atmosphere through the apertures 34 and 86 in registry. This position will be hereinafter referred to as the first position. It will be appreciated that closure flap 62 formed in the opposed side of the cover 14 is also manually placed in the first position.

Figure 3:
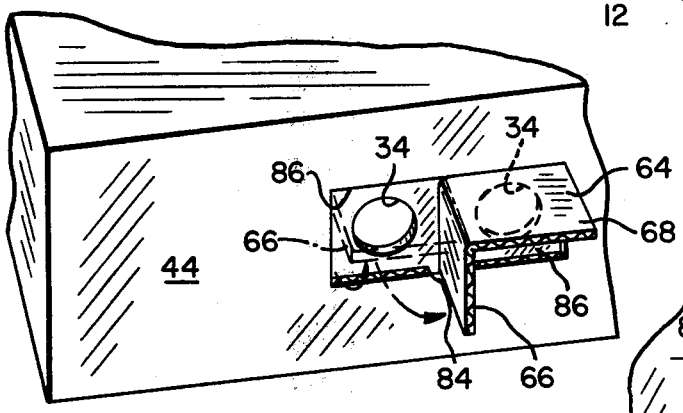
FIG. 3 is an enlarged isometric view showing a portion of one end of the shipping container of the present invention and showing details of the closure means.
Figure 4:
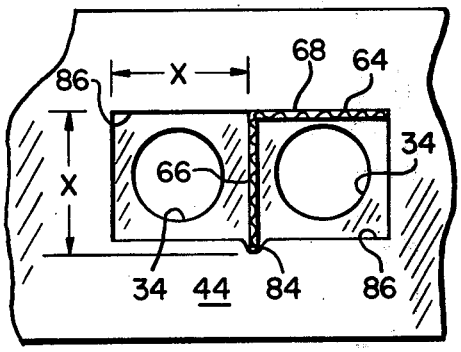
FIG. 4 is an enlarged end view showing details of the closure means incorporated on a container constructed in accordance with the teachings of the present invention.
Figure 5:
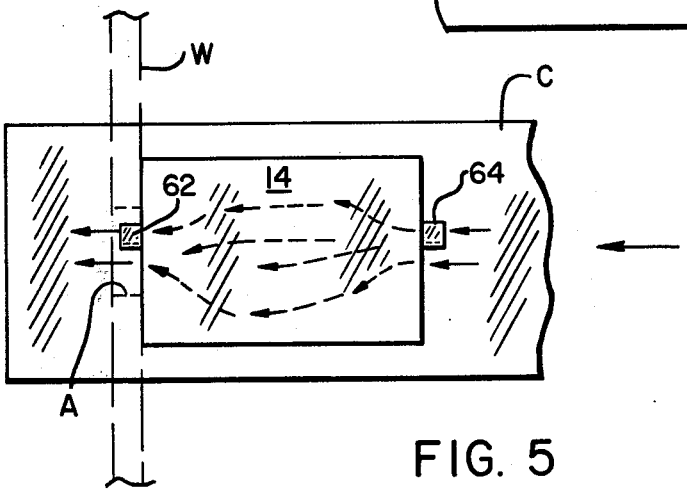
FIG. 5 is a plan view illustrating schematically how a container is utilized during the forced cooling operation.

Closure flap 64 is manually manipulated to the first position by grasping it and folding the closure flap about second hinge line 78 until it is at substantially right angles to the surface of cover side wall 44. Flap segment 66 is then bent about first hinge line 70 so that it is at right angles to flap segment 68 as shown in FIGS. 3 and 4. When in this position flap segment 66 is located in notch 84 which acts as a lock retaining the closure flap in the first position. With the closure flaps 64 and 62 both in the first position the interior of the box is cooled. FIG. 5 illustrates in schematic fashion one suitable approach for doing this. Assuming that the container is in a refrigerated room the container is brought into abutting engagement with a wall W of the room in which an aperture A is formed. Delivery of the container may be effected by means of a suitable conveyor C. The apertures associated with closure flap 62 are in alignment with aperture A and a vacuum is applied to the opposite side of wall W to withdraw air from the interior of the container. Cooled air flows in through the apertures associated with closure flap 64 into the interior of the container to replace the air that has been withdrawn therefrom under vacuum. After sufficient cooled air has been delivered into the interior of the container the container is removed from engagement with wall W and closure flaps 62 and 64 are quickly and easily manually manipulated into their respective second positions. This may be done simply with respect to closure flap 64 for example by bending flap segment 64 slightly upwardly as shown in FIGS. 3 and 4 so that the bottom of flap segment 66 will clear notch 84. Flap segment 66 is then brought into planar alignment with flap segment 64 and the closure flap is then pushed back into its second position. Frictional engagement between the closure flap and the surrounding portion of cover 14 forming aperture 86 will serve to retain the closure flap in the second position during shipment. If a more substantial closure is desired, a piece of tape or label can be applied over the closure flap.

I claim:

1. A shipping container for cut flowers and the like comprising:

a tray including a bottom wall and a plurality of tray side walls extending from said bottom wall, at least one of said tray side walls having an aperture formed therein;

a cover for placement on said tray, said cover including a top wall and depending cover side walls, at least one of said cover side walls having an aperture formed therein, said apertures being in registry when said cover is placed on said tray, said cover additionally including closure means manually movable between a first position whereat communication is established through said apertures in registry between the interior of the shipping container and ambient atmosphere and a second position whereat said communication is interrupted, and lock means for selectively retaining said closure means in said first position, said closure means comprising a hingedly secured closure flap having first and second adjacent flap segments hingedly secured to one another along a first hinge line and said flap segments being angularly disposed relative to one another about said first hinge line when said closure means is in said first position.

2. The container of claim 1 wherein said first flap segment is defined by said first hinge line, first and second lines of cut formed in said cover extending from opposed ends of said first hinge line and a third line of cut formed in said cover interconnecting said first and second lines of cut and spaced from said first hinge line, the second flap segment being defined by said first hinge line, a second hinge line between said flap and said cover and extending substantially at right angles to said first hinge line from one end thereof, a fourth line of cut formed in said cover extending from the other end of said first hinge line and a fifth line of cut formed in said cover extending between said fourth line of cut and said hinge line and spaced from said first hinge line.

3. The container of claim 2 wherein said second and fourth lines of cut are connected and form a notch in the cover in communication with said cover side wall aperture, said notch comprising said lock means and being disposed in alignment with said first hinge line when said closure flap is in said second position.

4. The container according to claim 3 wherein said first flap segment is positioned in said notch when said closure flap is in said first position to retain said closure flap in said first position.

5. The container of claim 2 wherein an aperture is formed in said tray side walls under each of said flap segments.

6. The container according to claim 2 wherein apertures are formed in more than one of said tray and cover side walls so that vacuum may be applied externally of one set of apertures in registry to introduce ambient atmosphere into the interior of the container through another set of apertures in registry when the closure flaps associated with said apertures are in said first position.

* * * * *